US006374788B1

(12) United States Patent
Fukuhara et al.

(10) Patent No.: US 6,374,788 B1
(45) Date of Patent: Apr. 23, 2002

(54) VALVE TIMING CONTROL DEVICE

(75) Inventors: Katsuyuki Fukuhara, Hyogo; Hiroyuki Kinugawa, Tokyo, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/891,172

(22) Filed: Jun. 26, 2001

(30) Foreign Application Priority Data

Dec. 25, 2000 (JP) ..... 2000-393403

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,823,152 A * 10/1998 Ushida ..... 123/90.17
5,943,989 A * 8/1999 Kira ..... 123/90.17
6,014,952 A * 1/2000 Sato et al. ..... 123/90.17
6,173,687 B1 * 1/2001 Fukuhara et al. ..... 123/90.17
6,302,072 B1 * 10/2001 Sekiya et al. ..... 123/90.17

FOREIGN PATENT DOCUMENTS

JP 10-159519 6/1998

* cited by examiner

*Primary Examiner*—Wellun Lo

(57) ABSTRACT

A valve timing control device has a purge path arranged at a vane of a rotor provided with a valve. The purge path communicates a retardation side oil hydraulic pressure chamber with an accommodation hole. Oil pressure in the retardation side oil hydraulic pressure chamber is supplied through the purge path to the accommodation hole to generate oil pressure acting to delay a release operation.

14 Claims, 8 Drawing Sheets

VALVE TIMING CONTROL DEVICE

BACKGROUND OF THE INVENTION

1. Field of the Invention

The present invention relates to a valve timing control device for modifying the opening and closing timing of the intake and exhaust valves in an internal-combustion engine (hereafter, referred as an engine) according to any operating condition.

2. Description of the Prior Art

Conventional valve timing control devices are known as shown in FIG. 1 to FIG. 4. FIG. 1 is a lateral cross sectional view of an internal construction of the conventional vane-type valve timing control device. FIG. 2 is a longitudinal cross sectional view taken along lines A—A of FIG. 1. FIG. 3 is a longitudinal cross sectional view of the conventional lock-release mechanism of FIG. 2. FIG. 4 is an enlarged perspective view of main points of the lock-release mechanism in the conventional valve timing control device of FIG. 1. FIG. 5 is a graph of relation defined between stroke in operation of a lock member in the lock-release mechanism of FIG. 2 and FIG. 3 and oil pressure. In FIG. 2, a right hand direction denotes forward, and a left hand direction denotes backward. In FIG. 2 and FIG. 3, a lower side denotes forward, and an upper side denotes backward.

In the drawings, reference numeral 1 denotes a first rotor which connects with a crankshaft (not shown) of the engine through chains (not shown) or belts (not shown) to rotate in synchronization with the crankshaft (not shown). The first rotor includes a sprocket 2, a case 3 and a cover 4, which are integrated with a threaded member 5 such as a bolt and so on. The sprocket 2 rotates in conjunction with the crankshaft (not shown). The case 3 has a plurality of shoes 3*a*, which are projected from an inner portion of the case 3 to constitute a plurality of oil hydraulic pressure chambers between the shoes 3*a*. The cover 4 covers the oil hydraulic pressure chambers constituted by the shoes 3*a* of the case 3.

A rotor (second rotor) 6 is arranged within the case 3, and allows relative rotation with respect to the first rotor 1. The rotor 6 is fixedly integrated with a camshaft 7 by using a threaded member 8 such as a bolt and so on, and the camshaft 7 relates to open/close of an intake valve or an exhaust valve. The rotor 6 has a plurality of vanes 6*a* of dividing the hydraulic pressure chambers above into an advance side oil hydraulic pressure chamber 9 and a retardation side oil hydraulic pressure chamber 10. A first oil path .(pressure supply path) 11 and a second oil path (pressure supply path) 12 are arranged within the camshaft 7. The first oil path 11 performs supply of oil hydraulic pressure to and discharge thereof from the advance side oil hydraulic pressure chamber 9. The second oil path 12 performs supply of oil hydraulic pressure to and discharge thereof from the retardation side oil hydraulic pressure chamber 10.

Seal means 13 are arranged on both of front ends of the shoes 3*a* of the case 3 and the vanes 6*a* of the rotor 6, respectively. The respective seal means 13 prevents leakage of oil between the both of the oil hydraulic pressure chambers 9 and 10. The seal means 13 includes a seal member 13*a* of sliding on an inner wall face of the oil hydraulic pressure chambers 9 and 10, and a plate spring 13*b* of biasing the seal member 13*a* toward the inner wall face.

An accommodation hole 14 is arranged at one of the vanes 6*a* of the rotor 6 which acts as the second rotor. A lock pin (lock member, lock mechanism) 15 having a cylindrical shape is accommodated in the hole 14 to restrict relative rotation of the first rotor 1 and the second rotor. Since oil hydraulic pressure in the valve timing control device is reduced on starting the engine, the rotor 6 vibrates in the rotational direction by a cam load applied to a cam (not shown) integrated with the camshaft 7 to repeat contact and separation between the first and second rotors. Therefore, the lock pin 15 is biased by an biasing member (lock mechanism) 16 such as coil springs to engage in an engagement hole will be explained hereafter, the biasing member 16 being arranged between a rear wall of the accommodation hole 14 and the lock pin 15. A discharge hole (release mechanism) is formed with the accommodation hole 14 to discharge a backward pressure of the lock pin 15.

On the other hand, an, engagement hole 18 is formed at the sprocket 2 which acts as the first rotor to allow insertion of the lock pin 15 when the rotor 6 positions at the most retardation with respect to the first rotor 1.

A valve 19 is arranged at the vane 6*a* having the accommodation hole 14. The valve 19 supplies selectively higher oil hydraulic pressure in the advance side oil hydraulic pressure chamber 9 and the retardation side oil hydraulic pressure chamber 10 to the engagement hole 18 to release engagement (hereafter, referred as lock) between the engagement hole and the lock pin 15. The valve (release mechanism) 19 communicates with the engagement hole 18 through a first release oil hydraulic supply path (release mechanism) 20 formed in the said vane 6*a* of the rotor 6 and a second release oil hydraulic supply path (release mechanism) 21 formed at the sprocket 2. The valve 19 communicates with the advance side oil hydraulic pressure chamber 9 through an advance side pressure partition path (release mechanism) 22, and communicates with the retardation side oil hydraulic pressure chamber 10 through a retardation side pressure partition path (release mechanism) 23.

Next, a release operation will be explained.

In a release operation, oil hydraulic pressure is supplied from an oil pump (not shown) to the engagement hole 18 through the chamber 9 or the chamber 10, the valve 19, the first release oil hydraulic supply path 20 and the second release oil hydraulic supply path 21. Release oil pressure is supplied to a space defined between an inner wall of the engagement hole 18 and an outer wall of the lock pin 15 within the engagement hole 18 to press the lock pin 15 against the biasing force of the biasing member 16. Thus, the lock pin 15 is moved backward in the accommodation hole 14 to release from the engagement hole 18. Backward pressure of the lock pin 15 is discharged from the accommodation hole 14 through the discharge hole 17 to the outside of the valve timing control device. A front end of the lock pin 15 released from the engagement hole 18 is accommodated in the accommodation hole 14 to allow free rotation between the first and second rotors.

Since an area subjected to oil pressure is constant from a locked state of the lock pin 15 to the end of a released state, a discharge speed of the backward pressure is also constant. Since strokes in the operation of the lock pin 15 are determined by the biasing force of the biasing member 16 and the oil pressure force, a one-on-one relation is established in the stroke and applied oil pressure. Therefore, release oil pressure is equal to holding-release oil pressure of holding the released state.

Incidentally, when the engine is stopped, oil in the advance side oil hydraulic pressure chamber 9 and the retardation side oil hydraulic pressure chamber 10 moves downwardly to an oil-pan (not shown) through the first and second oil path 11 and 12 and so on. Therefore, air accumulates in pipe arrangement such as the respective oil hydraulic pressure chambers and the respective oil paths. When the engine is restarted with the state above, oil hydraulic pressure rises by the oil pump (not shown) and simultaneously accumulated air in the pipe arrangement is discharged at once. Thus, the air-mixing oil is applied in the valve timing control device to release instantly the lock pin 15 from the engagement hole 18.

However, the following problems result from the above structure for a conventional valve timing control device.

When the air-mixing oil releases the lock on starting the engine, the oil hydraulic pressure in the advance side oil hydraulic pressure chamber 10 and the retardation side oil hydraulic pressure chamber 11 cannot absorb the cam load described above. Since the first rotor 1 and the second rotor repeat contact and separation there-between, beat noise (abnormal noise) necessarily results.

Other conventional valve timing control devices are known as disclosed in JP-A-1998/159519, for example. The device has a release path formed in a release oil hydraulic pressure chamber defined between a shoulder of a lock pin and an accommodation hole, and the release path discharges only air mixed in oil to the outside. Thus, the device solves the problem that engagement of the lock pin is accidentally released by the air mixed in oil before reaching a sufficient oil pressure. However, since oil and air (pressurized fluid) guided to the release path pass through the release oil hydraulic pressure chamber, air is slightly mixed with the oil acting on the lock pin. In this case, the release path is sealed by oil components having little effect on a release operation. Therefore, since there is a possibility of accidental release of the lock before reaching a sufficient oil pressure, this device does not solve the problem above.

SUMMARY OF THE INVENTION

Accordingly, it is an object of the present invention to provide a valve timing control device, which prevents the occurrence of beat noise (abnormal noise) in a release operation resulting from the air-mixing oil on starting the engine.

In order to achieve the object of the present invention, a valve timing control device comprises a first rotor of rotating in synchronization with a crankshaft of an internal combustion engine, the first rotor having a plurality of shoes inside thereof; a second rotor fixed on an end of an intake camshaft or an exhaust camshaft of the internal combustion engine and rotatably arranged in the first rotor, the second rotor having a plurality of vanes on the outside; an advance side oil hydraulic pressure chamber and a retardation side oil hydraulic pressure chamber defined between the vanes of the second rotor and the shoes of the first rotor; a lock member of locking the first and second rotors at a required angle which any one of the rotors forms with the other; an accommodation hole arranged at the second rotor, accommodating the lock member and biasing member for biasing the lock member, the accommodation hole having a discharge hole for discharging backward pressure of the lock member; an engagement hole arranged at the first rotor, allowing insertion of the lock member, the engagement hole having a release oil hydraulic supply path for supplying release oil pressure; an advance side pressure partition path communicating with the advance side oil hydraulic pressure chamber; a retardation side pressure partition path communicating with the retardation side oil hydraulic pressure chamber; and a purge path communicating at least one of the advance side oil hydraulic pressure chamber, the retardation side oil hydraulic pressure chamber, the advance side pressure partition path and the retardation side pressure partition path with ambient air. Thus, air or air-mixing oil, which is used as a first pressure in a release operation on starting the engine, can be positively discharged to the outside. It is not necessary to use all the first pressure for the release operation, and the lock member can be released after applying oil hydraulic pressure which is able to control the valve timing control device. Therefore, it can prevent the occurrence of beat noise (abnormal noise).

The purge path may be arranged in the accommodation hole functioning as a backward chamber of the lock member to communicate with at least one of the advance side oil hydraulic pressure chamber, the retardation side oil hydraulic pressure chamber, the advance side pressure partition path and the retardation side pressure partition path. Thus, the oil pressure of air-mixing oil, which is supplied to the accommodation hole through the purge path, acts on against release oil pressure supplied to the engagement hole through release oil hydraulic supply path. Therefore, the release operation can be delayed until applying oil hydraulic pressure which is able to control the valve timing control device to prevent the occurrence of beat noise (abnormal noise).

The device may further comprise a drain path communicating the purge path with ambient air, wherein the drain path and the purge path are arranged in the accommodation hole which functions as a backward chamber of the lock member, and wherein the purge path communicates with at least one of the advance side oil hydraulic pressure chamber, the retardation side oil hydraulic pressure chamber, the advance side pressure partition path and the retardation side pressure partition path. Thus, the oil pressure of air-mixing oil, which is supplied to the accommodation hole through the purge path, acts against release oil pressure supplied to the engagement hole through release oil hydraulic supply path. Therefore, the release operation can be delayed to prevent the occurrence of beat noise (abnormal noise). Moreover, air-mixing oil can be quickly discharged in the release operation through the drain path.

The purge path may communicate the retardation side oil hydraulic pressure chamber or the retardation side pressure partition path with ambient air. Thus, oil pressure of air-mixing oil is supplied from the retardation side oil hydraulic pressure chamber or the retardation side oil pressure partition path to the accommodation hole through the purge path, and acts on against release oil pressure supplied to the engagement hole through release oil hydraulic supply path. As a result, the release operation can be delayed.

The purge path may be connected to the accommodation hole so as to be closed by the lock member in a release operation. Thus, oil supply from the purge path to the accommodation hole can be closed in the release operation after discharging the air-mixing oil to prevent residual oil pressure in the accommodation hole.

The purge path may be connected to the accommodation hole during a period from the start of lock operation to that of required stroke operation of the lock member. Thus, oil supply from the purge path to the accommodation hole can be closed during the period to prevent residual oil pressure in the accommodation hole.

The device may further comprise a choke arranged in the purge path, wherein the choke may narrow an opening area of the purge path. Thus, path resistance can be increased to restrict passing of non-compressive oil with high viscosity through the purge path to allow selectively passing of compressive air with low viscosity through it.

An opening area of the purge path may be narrower than that of a pressure supply path communicating with the advance side oil hydraulic pressure chamber and the retardation side oil hydraulic pressure chamber. Thus, oil pressure in the advance side oil hydraulic pressure chamber and the retardation side oil hydraulic pressure chamber can be held at a constant level.

An opening area of the purge path may be generally equal to, or may be wider than that of the discharge hole or the drain path. Thus, oil pressure acting to delay the release operation can be created.

The device may further comprise a choke arranged in the discharge hole or the drain path, and narrow an opening area thereof. Thus, path resistance can be increased to restrict passing of non-compressive oil with high viscosity through the purge path to allow selectively passing of compressive air with low viscosity through it. Moreover, since discharge of oil can be restricted, even when the lock member is in a locked state to restrict a rotation of the first and second rotors to open the purge path, consumption of oil in an oil-circulating system can be minimized to avoid a breakdown of the engine for the reason of a shortage of lubricating oil.

An opening area of the purge path may be wider than any opening area of the advance side pressure partition path, the retardation side pressure partition path and the release oil hydraulic supply path. Path resistance can be reduced to move up the sequence of supply of the oil pressure to the purge path.

The device may further comprise a choke of narrowing an opening area of the retardation side pressure partition path or the release oil hydraulic supply path. Thus, the major portion of the air-mixing oil can be discharged through the purge path rather than the retardation side pressure partition or the release oil hydraulic supply path.

An opening area of an oil path may be set by a relation of a pressure supply path≧the purge path≧a drain path≧the release oil hydraulic supply path. Thus, the major portion of the air-mixing oil can be discharged through the purge path rather than the release oil hydraulic supply path. Moreover, discharge of non-compressive oil with high viscosity can be restricted in the drain path to allow selectively discharging of compressive air with low viscosity.

The device further comprise a valve having the advance side pressure partition path and the retardation side pressure partition path, wherein the valve may supply high oil pressure to the release oil hydraulic supply path, the supplied high oil pressure being selected from oil pressure in the advance side oil hydraulic pressure chamber and the retardation side oil hydraulic pressure chamber. Thus, air or air-mixing oil, which is used as a first pressure in a release operation on starting the engine, can be positively discharged to the outside. It is not necessary to use all the first pressure for the release operation, and the lock member can be released after applying oil hydraulic pressure which is able to control the valve timing control device. Therefore, it can prevent the occurrence of beat noise (abnormal noise).

BRIEF DESCRIPTION OF THE DRAWINGS

FIG. 9A shows a locked state, and FIG. 9B shows a released state.

DESCRIPTION OF THE PREFERRED EMBODIMENT OF THE INVENTION

Hereafter, one embodiment according to the present invention will be explained.

Embodiment 1

Figure 1:
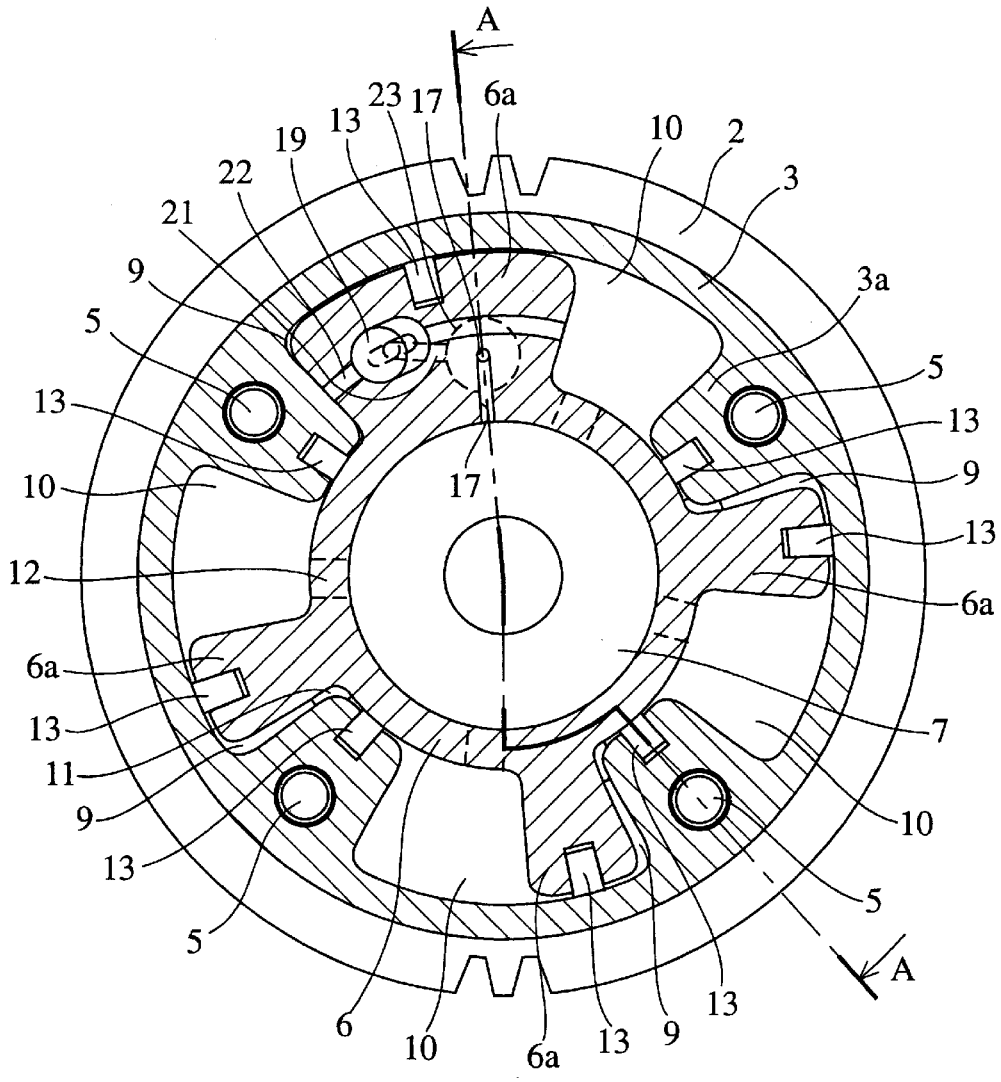
FIG.1 (PRIOR ART)
FIG. 1 is a lateral cross sectional view of an internal construction of the conventional vane-type valve timing control device.
Figure 2:
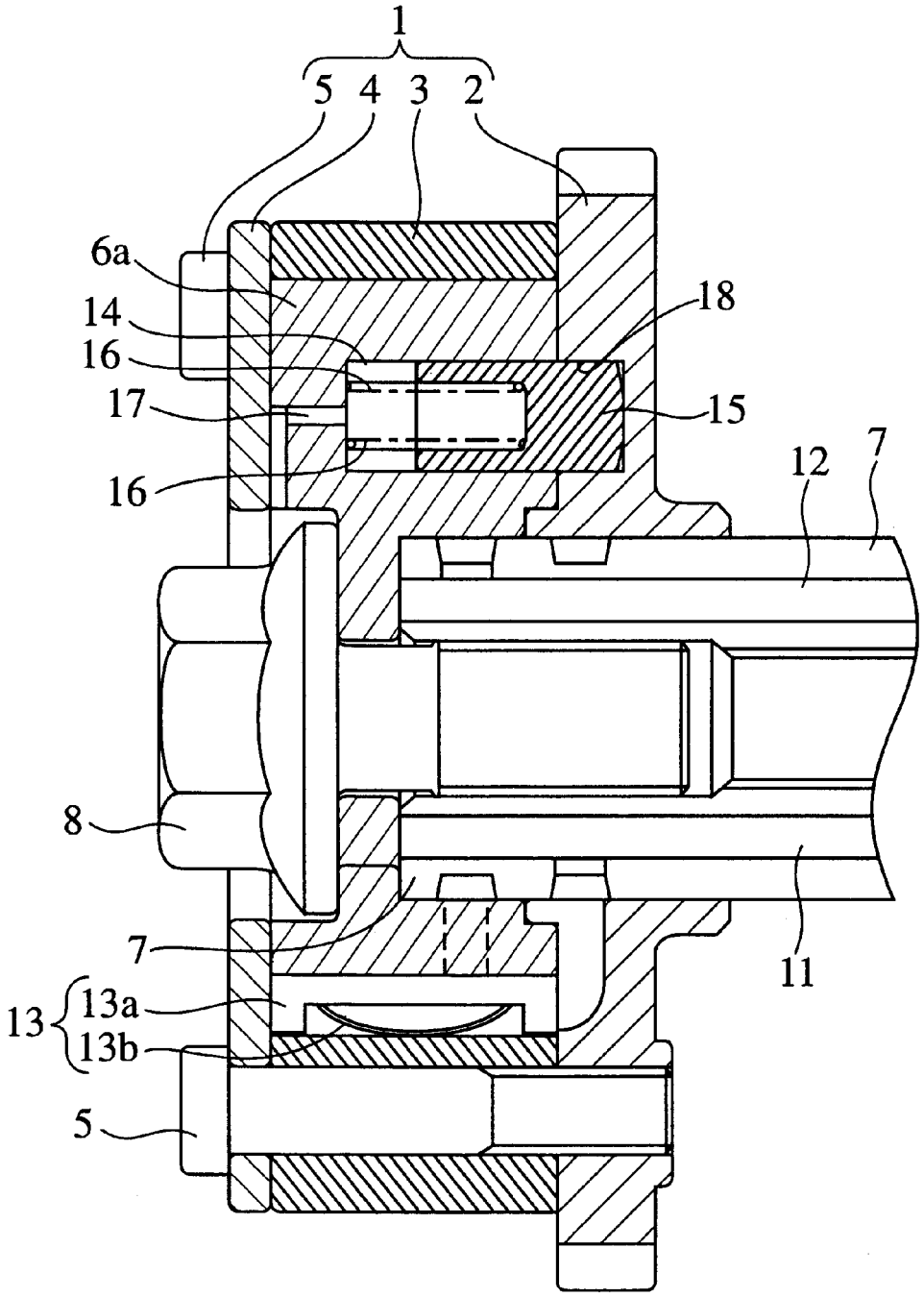
FIG.2 (PRIOR ART)
FIG. 2 is a longitudinal cross sectional view taken along lines A—A of FIG. 1.
Figure 3:
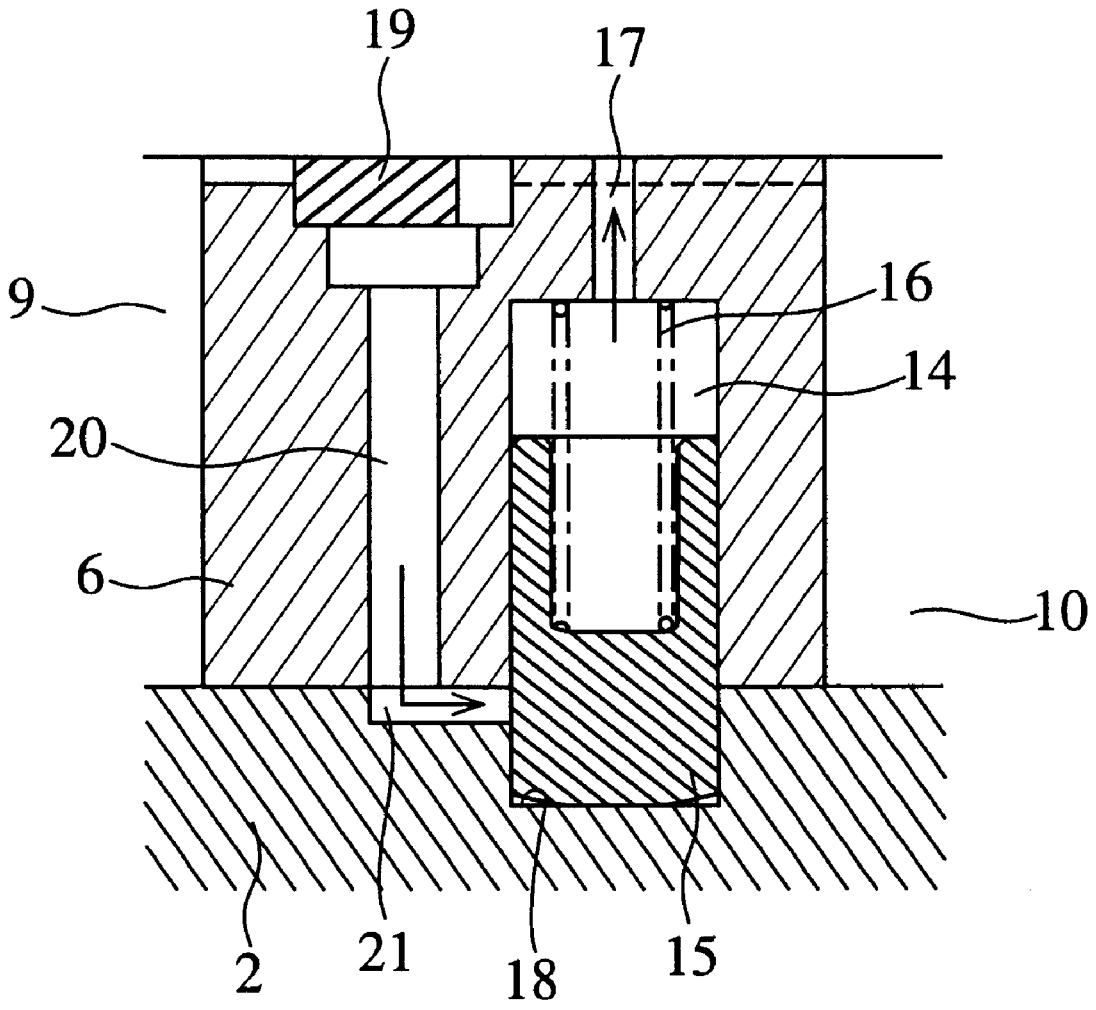
FIG.3 (PRIOR ART)
FIG. 3 is a longitudinal cross sectional view of the conventional lock-release mechanism of FIG. 2.
Figure 4:
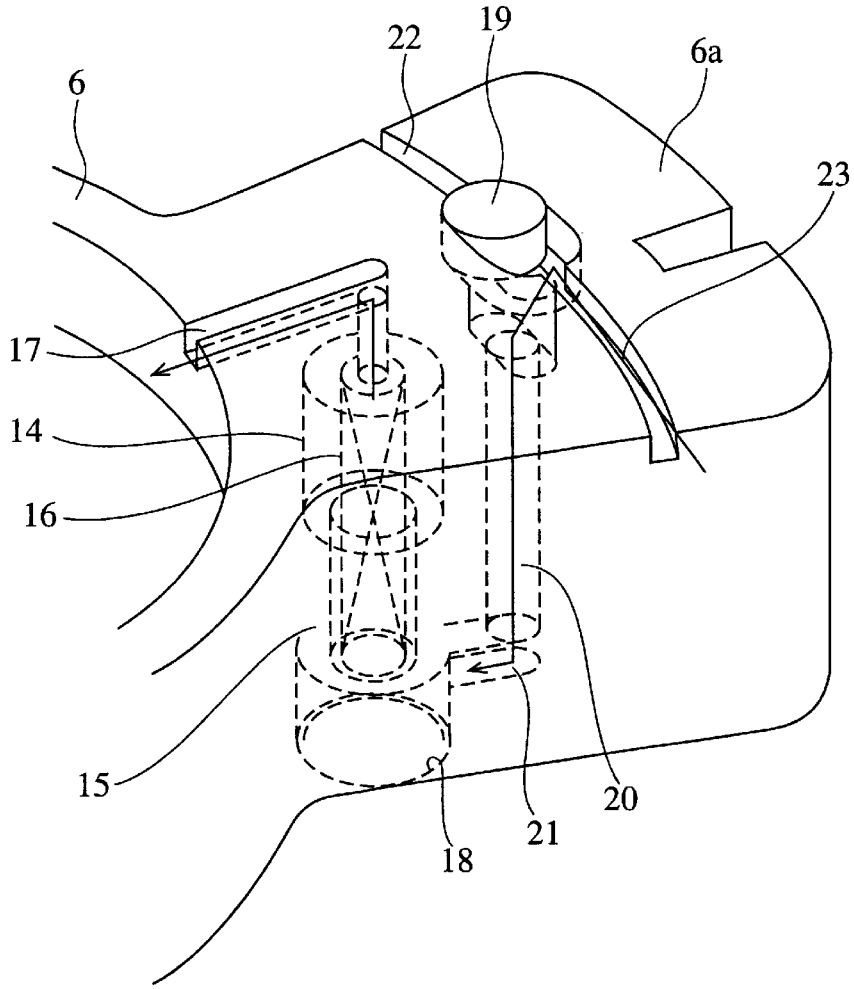
FIG.4 (PRIOR ART)
FIG. 4 is an enlarged perspective view of main points of the lock-release mechanism in the conventional valve timing control device of FIG. 1.
Figure 5:
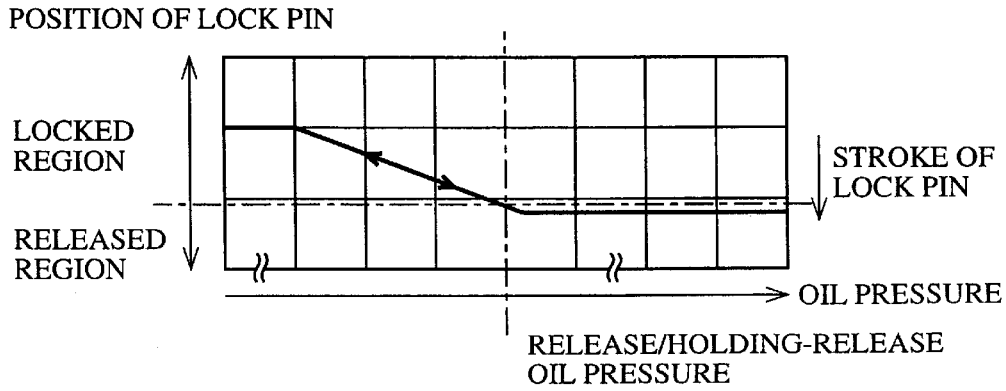
FIG.5 (PRIOR ART)
FIG. 5 is a graph of relation defined between stroke in the operation of a lock member in the lock-release mechanism of FIG. 2 and FIG. 3 and oil pressure.
Figure 6:
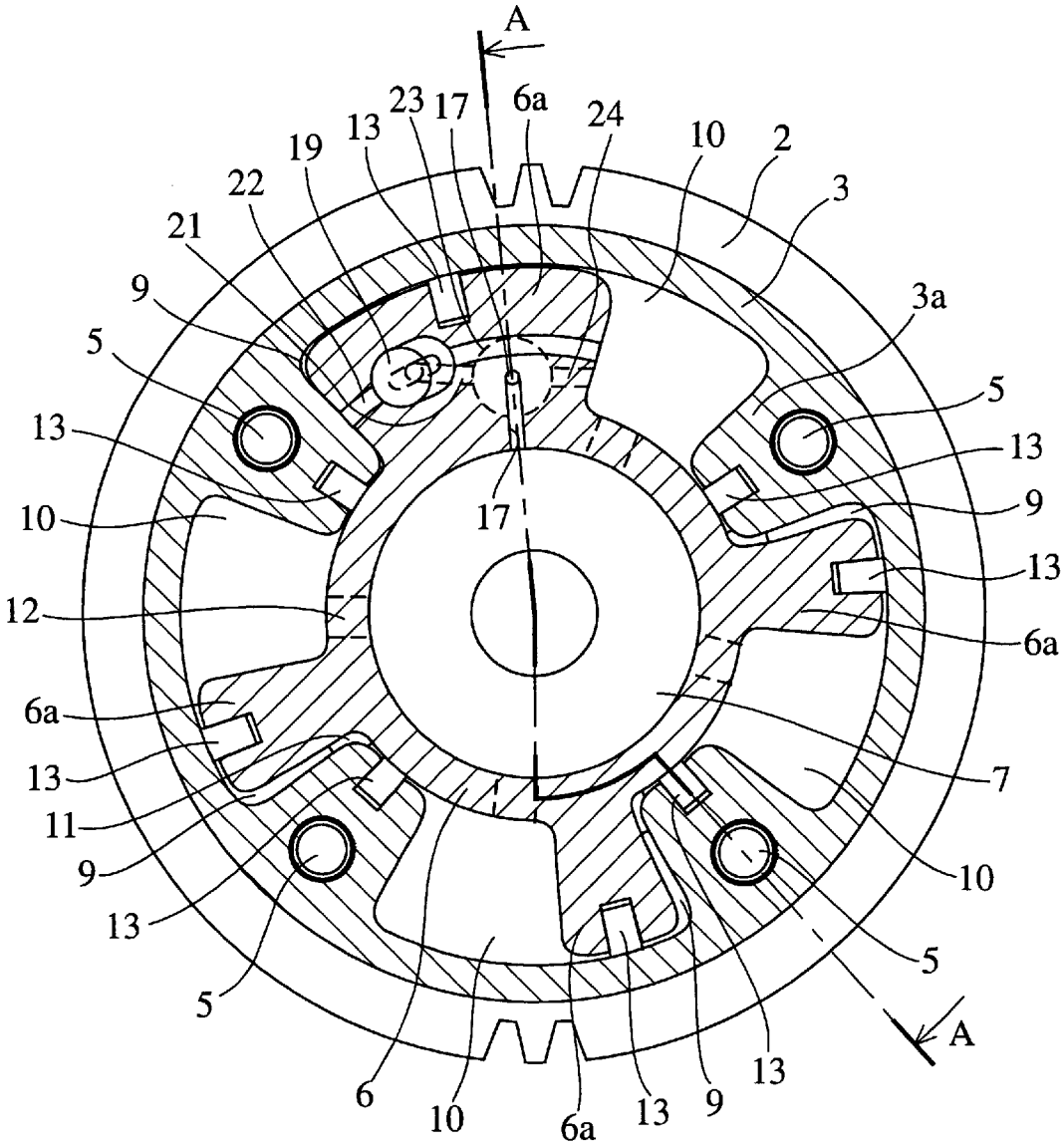
FIG. 6 is a lateral cross sectional view of an internal construction of a valve timing control device as embodiment 1 according to the present invention.
Figure 7:
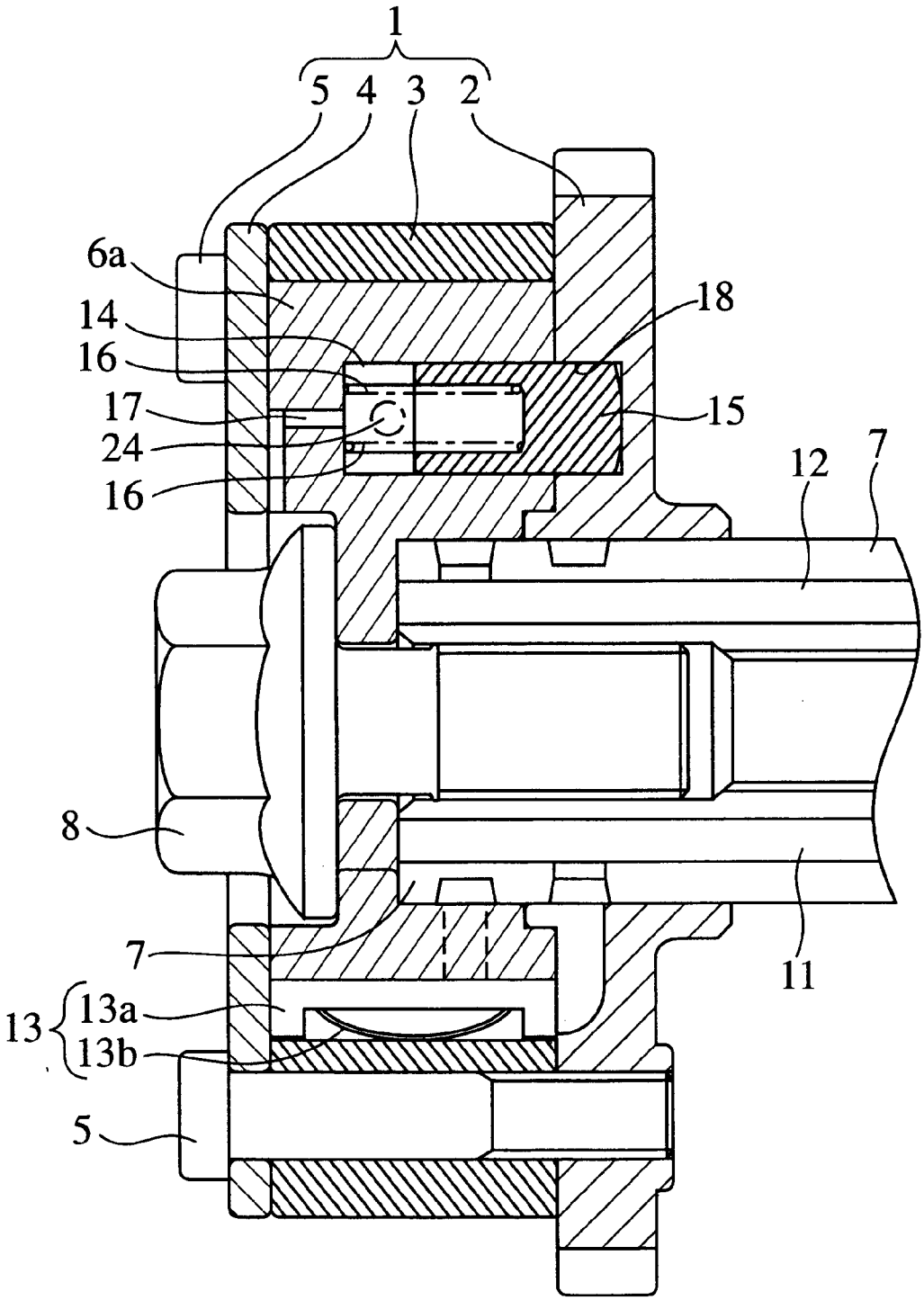
FIG. 7 is a longitudinal cross sectional view taken along lines A—A of FIG. 6.
Figure 8:
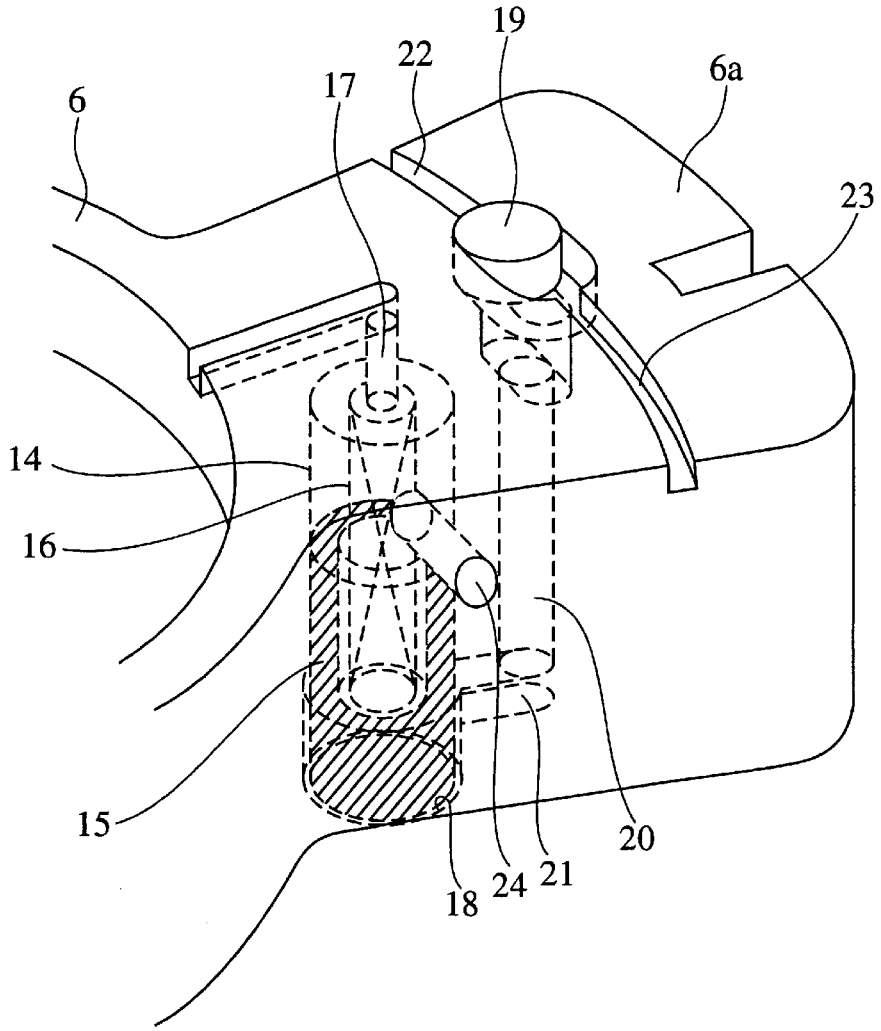
FIG. 8 is an enlarged perspective view of main points of a lock-release mechanism in the valve timing control device of FIG. 6 and FIG. 7.
Figure 10:
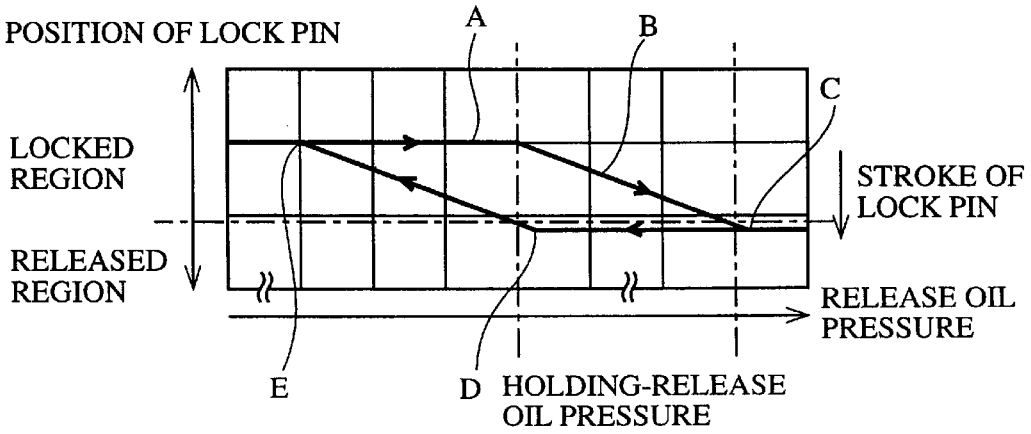
FIG. 10 is a graph of a relation defined between the stroke in operation of a lock member in the lock-release mechanism in the valve timing control device of FIG. 6 to FIG. 9B and the oil pressure applied to the lock-release mechanism.
Figure 9A:
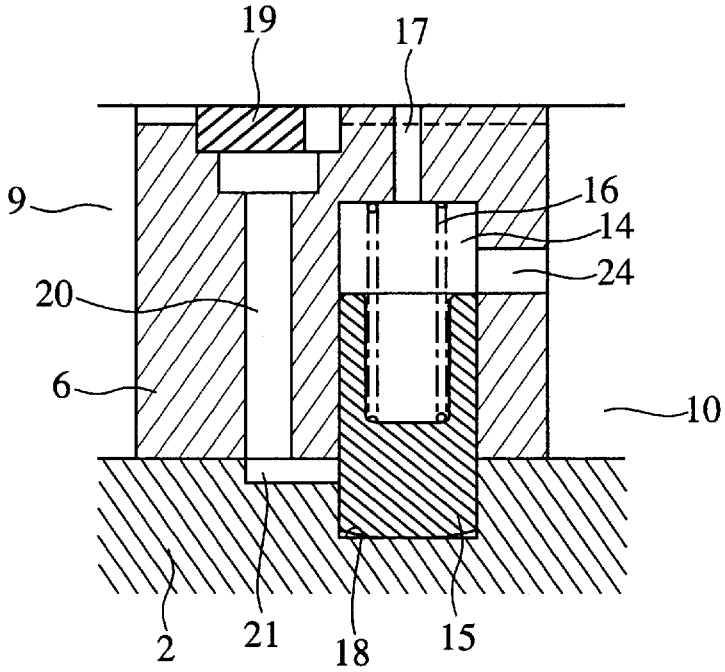
FIG. 9A and FIG. 9B are longitudinal cross sectional views of the operation of the lock-release mechanism in the valve timing control device of FIG. 6 to FIG. 8.
Figure 9B:
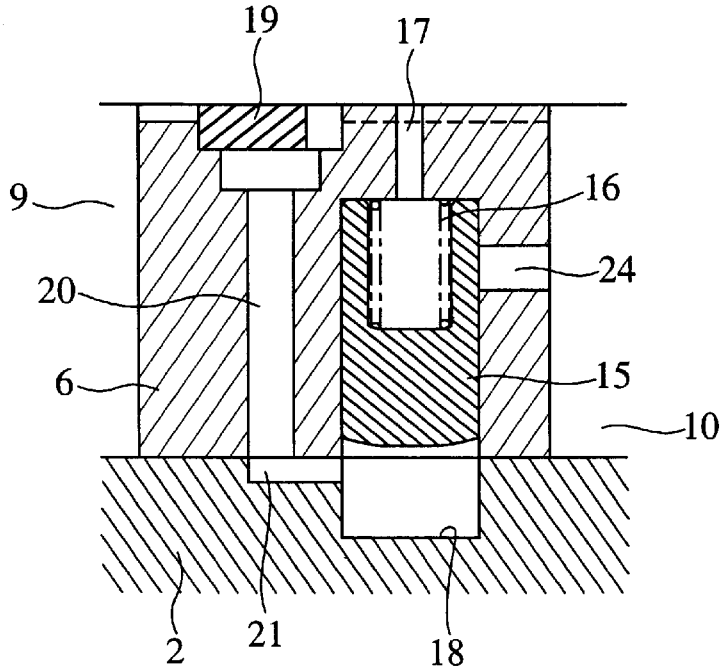

FIG. 6 is a lateral cross sectional view of an internal construction of a valve timing control device as embodiment 1 according to the present invention. FIG. 7 is a longitudinal cross sectional view taken along lines A—A of FIG. 6. FIG. 8 is an enlarged perspective view of main points of a lock-release mechanism in the valve timing control device of FIG. 6 and FIG. 7. FIG. 9A and FIG. 9B are longitudinal cross sectional views of operation of the lock-release mechanism in the valve timing control device of FIG. 6 to FIG. 8, FIG. 9A shows a locked state, and FIG. 9B shows a released state. FIG. 10 is a graph of the relation defined between the stroke in the operation of a lock member in the lock-release mechanisms in the valve timing control device of FIG. 6 to FIG. 9B and the oil pressure applied to the lock-release mechanism. In the drawings, since the common numerals denote common elements in the conventional structure of FIG. 1 to FIG. 5, the description of such parts is omitted.

The embodiment 1 is characterized in that a purge path 24 is arranged at the vane 6*a* of the rotor 6 having the valve 19 to communicate the retardation side oil hydraulic pressure chamber 10 with the accommodation hole 14 as shown in FIG. 6 to FIG. 9B. A drain side-opening end of the purge path 24 communicates with the accommodation hole 14 through an inner wall of the hole 14. The drain side-opening end of the purge path 24 is set to a position that the end is closed by the circumferential wall of the lock pin 15 in a release operation, and that the end is opened in a lock operation. The discharge hole 17, which is arranged in the accommodation hole 14, also serves as a drain path communicating the purge path 24 with ambient air in the embodiment 1.

In the relationship between the valve 19 and the purge path 24, the difference in parameter such as path resistance or path length is set to supply oil pressure applied to the chamber 10 on starting the engine to the purge path 24 and the valve 19 in the order. In other words, an opening area of the purge path 24 is equal to or wider than that of the first release oil hydraulic supply path 20, the second release oil hydraulic supply path 21 and the retardation side pressure partition path 23, each path communicating with the valve 19. Thus, the path resistance of the purge path 24 can be equal to or lower than that of the paths 20, 21, and 23. A length of the purge path 24 is equal to or shorter than that of the retardation side pressure partition path 23 of the valve 19. Thus, the oil pressure from the retardation side oil hydraulic pressure chamber 10 can be supplied to the purge path 24 and the retardation side pressure partition path 23 at the same time. Alternatively, the oil pressure from the retardation side oil hydraulic pressure chamber 10 can be supplied to the purge path 24 at an earlier time than the retardation side pressure partition path 23. The parameter is set to an appropriate lever to control the sequence of supply of the oil pressure.

In order to keep the oil pressure in the retardation side oil hydraulic pressure chamber 10, the opening area of the purge path 24 is equal to or narrower than that of the second oil path 12. In order to generate the oil pressure acting to delay a release operation, the opening area of the purge path 24 is equal to or wider than that of the discharge hole 17.

Here, the opening area of the paths above is summarized in the following relation:

The second oil path 12 which acts as the pressure supply path≧the purge path 24≧the discharge hole 17 which acts as the drain path≧the first or second release oil hydraulic supply path 20 or 21.

Next, a release operation and a lock operation will be explained.

With the embodiment 1, the engagement hole 18 allows insertion of the lock pin 15 by the biasing force of the biasing member 16 when the rotor 6 which acts as the second rotor positions at the most retardation with respect to the first rotor 1 on stopping the engine. Thus, the free rotation of the first rotor 1 and the second rotor 6 is restricted. When the lock is therefore released, the oil pressure delivered from the oil pump (not shown) is primarily supplied to the retardation side oil hydraulic pressure chamber 10 through the second oil path 12. This oil pressure is supplied to the purge path 24 and the valve 19 in order, depending on the difference in the path resistance or the length. Since the opening area of the discharge hole 17 is narrower than that of the purge path 24, and the path resistance of the discharge hole 17 is larger than that of the purge path 24, the air-mixing oil accumulated in the retardation side oil hydraulic pressure chamber 10 and the pipe arrangement is applied to the accommodation hole 14 through the purge path 24 to confine the oil pressure in a rear portion of the lock pin 15 in the accommodation hole 14. The residual oil pressure acts on the lock pin 15 in the same direction as the biasing force of the biasing member 16.

Next, the oil pressure in the retardation side oil hydraulic pressure chamber 10 is supplied to the engagement hole 18 through the retardation side pressure partition path 23, the valve 19, the first and second release oil hydraulic supply paths 20 and 21. The release oil pressure which is supplied to a space between the inner wall of the engagement hole 18 and the outer wall of the lock pin 15 presses the lock pin 15 in a release direction against the sum of the biasing force of the biasing member 16 and the oil pressure confined in the accommodation hole 14 (A of FIG. 10).

Next, the oil pressure for generating the residual oil pressure in the accommodation hole 14 is slowly discharged from the discharge hole 17 to the outside, and the lock pin 15 moves backward in the accommodation hole 14 under the release oil pressure (B of FIG. 10). The lock pin 15 is released from the engagement hole 18 to release the lock (point C of FIG. 10) to allow the free rotation of the first rotor 1 and the second rotor 6. Here, since a drain side-opening end of the purge path 24 is closed by the circumferential wall of the lock pin 15 moving backward in the accommodation hole 14 in thus released state, the residual oil pressure does not generate in the accommodation hole 14. Therefore, since an oil pressure for holding the released state, or a holding-release oil pressure is equivalent to the biasing force of the biasing member 16, the holding-release oil pressure is lower than the release oil pressure (point D of FIG. 10).

Next about locking, the engine stops to move downwardly the oil in the valve timing control device to the oil-pan (not shown). Thus, the oil pressure in the engagement hole 18 is reduced, and the lock pin 15 moves forward by the biasing force of the biasing member 16 to engage with the engagement hole 18 (point E of FIG. 10). With the embodiment, the lock pin is arranged at the first rotor, and the accommodation hole is arranged in the second rotor 6. Alternatively, the accommodation hole may be arranged in the first rotor, and the lock pin may be arranged at the second rotor 6.

As described above, according to the embodiment 1, the purge path 24 communicating with the retardation side oil hydraulic pressure chamber 10 is arranged in the accommodation hole 14 which acts as the backward pressure chamber of the lock pin 15. Thus, the oil pressure applied through the purge path 24 to the accommodation hole 14 acts as the residual oil pressure in the same direction of the biasing force of the biasing member 16 against the release oil pressure. Therefore, the release operation can be delayed until applying an oil hydraulic pressure which is able to control the valve timing control device.

With the embodiment 1, the drain side-opening end of the purge path 24 is set to a position that the end is closed by the circumferential wall of the lock pin 15 in a release operation, and that the end is opened in a lock operation. In the locked operation, the residual oil pressure acting on the lock pin 15 in the same direction of the biasing force of the biasing member 16 is generated, and the residual oil pressure is not generated in the released operation. Thus, release oil pressure characteristics can be provided with a hysteresis characterized in that the release oil pressure acting on the lock pin 15 against the sum of the biasing force of the biasing member 16 and the residual oil pressure stands out from the holding-release oil pressure equivalent to only the biasing force of the biasing member 16. The release operation can be therefore delayed and after the release the released state of the lock pin 15 can be held under a lower oil pressure which generates on idling of the engine, for example. Thus, when rotating the engine, the relative rotation of the first rotor 1 and the second rotor 6 can be maintained in order to control the valve timing control device.

With the embodiment, the opening area difference between the oil paths is set to create the difference in the path resistance. Alternatively, the oil paths may have the partial choke to increase the path resistance. In this case, the oil path having the choke can push back the sequence of supply of the oil pressure thereto.

With the embodiment 1, the purge path 24 is provided to communicate the retardation side oil hydraulic pressure chamber 10 with the accommodation hole 14 acting as the backward pressure chamber of the lock pin 15. Alternatively, a purge path may be provided to communicate oil paths supplied from the retardation side oil hydraulic pressure chamber 10 with the accommodation hole 14. Such oil paths include the retardation side pressure partition path 23 communicating with the valve 19, the first release oil hydraulic supply path 20 or the second release oil hydraulic supply path 21. When the engagement hole 18 allows insertion of the lock pin 15 by the biasing force of the biasing member 16 when the rotor 6 which acts as the second rotor positions at the most advance angular with respect to the first rotor 1 on stopping the engine to restrict the free rotation of the first rotor 1 and the second rotor 6, the purge path 24 may be provided to communicate the advance side oil hydraulic pressure chamber 9 with the accommodation hole 14. Alternatively, a purge path may be provided to communicate oil paths supplied from the advance side oil hydraulic pressure chamber 9 with the accommodation hole 14. Such oil paths include the advance side pressure partition path 22 communicating with the valve 19, the first release oil hydraulic supply path 20 or the second release oil hydraulic supply path 21.

With the embodiment 1, one purge path is provided. The present invention is not limited to this construction. A second purge path may be provided to communicate the accommodation hole 14 with the respective oil paths, for example.

With the embodiment 1, the purge path is provided to communicate the retardation side oil hydraulic pressure chamber 10 with the accommodation hole 14. Alternatively, at least one purge path may be provided to communicate at least one of the advance side oil hydraulic pressure chamber 9, the retardation side oil hydraulic pressure chamber 10, the advance side pressure partition path 22 communicating with the valve 19, the retardation side pressure partition path 23 communicating with the valve 19, the first release oil hydraulic supply path 20 or the second release oil hydraulic supply path 21 with ambient air. In this case, air or air-mixing oil, which is used as first pressure in a release operation on starting the engine, can be positively discharged to the outside. It is not necessary to use all the first pressure for the release operation, and the lock member can be released after applying oil hydraulic pressure which is able to control the valve timing control device.

With the embodiment 1, the discharge hole 17 also serves as the drain path. Alternatively, a second drain path may be provided to communicate the purge path with the ambient air. As in the case of the discharge hole 17, an opening area of the second drain path may be smaller than that of the purge path 24, and a choke may be arranged therein. Thus, the path resistance of the accommodation hole 14 is larger than that of the purge path 24 to generate the residual oil pressure in the accommodation hole 14. The release operation can be delayed under the residual oil pressure to prevent the occurrence of beat noise (abnormal noise).

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a first rotor rotating in synchronization with a crankshaft of an internal combustion engine, the first rotor having a plurality of shoes inside thereof;

a second rotor fixed on an end of an intake camshaft or an exhaust camshaft of the internal combustion engine and rotatably arranged in the first rotor, the second rotor having a plurality of vanes on the outside;

an advance side oil hydraulic pressure chamber and a retardation side oil hydraulic pressure chamber defined between the vanes of the second rotor and the shoes of the first rotor;

a lock member locking the first and second rotors at a required angle which any one of the rotors forms with the other;

an accommodation hole arranged at the second rotor, accommodating the lock member and biasing member for biasing the lock member, the accommodation hole having a discharge hole for discharging backward pressure of the lock member;

an engagement hole arranged at the first rotor, allowing insertion of the lock member, the engagement hole having a release oil hydraulic supply path for supplying release oil pressure;

an advance side pressure partition path communicating with the advance side oil hydraulic pressure chamber;

a retardation side pressure partition path communicating with the retardation side oil hydraulic pressure chamber; and a purge path communicating at least one of the advance side oil hydraulic pressure chamber, the retardation side oil hydraulic pressure chamber, the advance side pressure partition path and the retardation side pressure partition path with ambient air.

2. A valve timing control device according to claim 1, wherein the purge path is arranged in the accommodation hole functioning as a backward chamber of the lock member to communicate with at least one of the advance side oil hydraulic pressure chamber, the retardation side oil hydraulic pressure chamber, the advance side pressure partition path and the retardation side pressure partition path.

3. A valve timing control device according to claim 1, further comprising a drain path communicating the purge path with ambient air, wherein the drain path and the purge path are arranged in the accommodation hole which functions as a backward chamber of the lock member, and wherein the purge path communicates with at least one of the advance side oil hydraulic pressure chamber, the retardation side oil hydraulic pressure chamber, the advance side pressure partition path and the retardation side pressure partition path.

4. A valve timing control device according to claim 1, wherein the purge path communicates the retardation side oil hydraulic pressure chamber or the retardation side pressure partition path with ambient air.

5. A valve timing control device according to claim 2, wherein the purge path is connected to the accommodation hole so as to be closed by the lock member in a release operation.

6. A valve timing control device according to claim 2, wherein the purge path is connected to the accommodation hole during a period from the start of lock operation to that of required stroke operation of the lock member.

7. A valve timing control device according to claim 1, further comprising a choke arranged in the purge path, wherein the choke narrows an opening area of the purge path.

8. A valve timing control device according to claim 1, wherein an opening area of the purge path is narrower than that of a pressure supply path communicating with the advance side oil hydraulic pressure chamber and the retardation side oil hydraulic pressure chamber.

9. A valve timing control device according to claim 3, wherein an opening area of the purge path is generally equal to, or is wider than that of the discharge hole or the drain path.

10. A valve timing control device according to claim 3, further comprising a choke arranged in the discharge hole or the drain path, and narrows an opening area thereof.

11. A valve timing control device according to claim 1, wherein an opening area of the purge path is wider than any opening area of the advance side pressure partition path, the retardation side pressure partition path and the release oil hydraulic supply path.

12. A valve timing control device according to claim 1, further comprising a choke for narrowing an opening area of the retardation side pressure partition path or the release oil hydraulic supply path.

13. A valve timing control device according to claim 1, wherein an opening area of an oil path is set by a relation of a pressure supply path≧the purge path≧a drain path≧the release oil hydraulic supply path.

14. A valve timing control device according to claim 2, further comprising a valve having the advance side pressure partition path and the retardation side pressure partition path, wherein the valve supplies high oil pressure to the release oil hydraulic supply path, the supplied high oil pressure being selected from oil pressure in the advance side oil hydraulic pressure chamber and the retardation side oil hydraulic pressure chamber.

* * * * *